US007917060B2

(12) United States Patent
Miura

(10) Patent No.: US 7,917,060 B2
(45) Date of Patent: Mar. 29, 2011

(54) IMAGE FORMING APPARATUS HAVING A SENSOR BLOCKING DEVICE

(75) Inventor: Yohei Miura, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 12/213,746

(22) Filed: Jun. 24, 2008

(65) Prior Publication Data

US 2009/0003877 A1 Jan. 1, 2009

(30) Foreign Application Priority Data

Jun. 27, 2007 (JP) ..... 2007-169088

(51) Int. Cl.
*G03G 15/16* (2006.01)

(52) U.S. Cl. ..... 399/121; 399/297; 399/301; 347/116

(58) Field of Classification Search ..... 399/121, 399/297, 301; 347/116
See application file for complete search history.

(56) References Cited

U.S. PATENT DOCUMENTS

| | | | | |
|---|---|---|---|---|
| 5,596,395 | A * | 1/1997 | Sawamura et al. | |
| 2001/0031148 | A1 | 10/2001 | Kajiwara et al. | |
| 2006/0228124 | A1 * | 10/2006 | Igarashi | |
| 2007/0231002 | A1 * | 10/2007 | Kouzu | 399/121 |
| 2008/0187343 | A1 * | 8/2008 | Yamaguchi et al. | 399/74 |
| 2008/0292360 | A1 * | 11/2008 | Hirai | |
| 2009/0154945 | A1 * | 6/2009 | Tomita et al. | 399/49 |
| 2010/0014878 | A1 * | 1/2010 | Tomita | 399/49 |

FOREIGN PATENT DOCUMENTS

| | | | |
|---|---|---|---|
| JP | 06-324536 | | 11/1994 |
| JP | 10-020616 | | 1/1998 |
| JP | 2003-195578 | | 7/2003 |
| JP | 2004-138776 | | 5/2004 |
| JP | 2004-184710 | * | 7/2004 |
| JP | 2005-070676 | | 3/2005 |
| JP | 2006-003399 | | 1/2006 |
| JP | 2006-091904 | | 4/2006 |
| JP | 2007-079414 | | 3/2007 |

OTHER PUBLICATIONS

Search Report for European patent application No. 08 252 134.5 dated Jan. 18, 2010.
European Search Report dated Oct. 13, 2008.

* cited by examiner

*Primary Examiner* — David M Gray
*Assistant Examiner* — G. M. Hyder
(74) *Attorney, Agent, or Firm* — Harness, Dickey & Pierce, P.L.C.

(57) ABSTRACT

An image forming apparatus includes an image forming unit configured to form a toner image on an image bearing member, an endless belt configured to transfer and carry the toner image thereon, a transfer unit configured to transfer the toner image carried by the endless belt onto a recording sheet, a sensing unit configured to sense the toner image transferred onto the endless belt, a blocking unit mounted between the sensing unit and the endless belt and configured to block the sensing unit, a contact and separation unit configured to cause the transfer unit to reciprocally contact and separate from the endless belt. With this configuration, the blocking unit and the contact and separation unit are configured to be driven by an identical drive source.

11 Claims, 6 Drawing Sheets

IMAGE FORMING APPARATUS HAVING A SENSOR BLOCKING DEVICE

CROSS-REFERENCE TO RELATED APPLICATIONS

The present patent application claims priority under 35 U.S.C. §119 from Japanese Patent Application No. 2007-169088, filed on Jun. 27, 2007 in the Japan Patent Office, the contents and disclosure of which are hereby incorporated by reference herein in their entirety.

BACKGROUND OF THE INVENTION

1. Field of the Invention

Exemplary embodiments of the present invention generally relate to an image forming apparatus that can effectively use a drive unit for image forming.

2. Discussion of the Related Art

A four-drum-type image forming apparatus, also called a tandem-type electrophotographic image forming apparatus, is expected to meet recent demands for an increase in print speed and image quality of color image forming apparatuses and is increasing its share of the market therefor.

In one known tandem-type electrophotographic image forming apparatus, four image forming units form single color toner images different from each other on respective surfaces of image bearing members provided therein, and the single color toner images are sequentially transferred either directly onto a transfer sheet carried by a sheet conveyor belt or onto an image transfer belt before the transfer sheet so as to form a composite, full-color toner image fast. In an effort to effectively increase both the print speed and the image quality further, attention has focused on an intermediate transfer unit as a transfer unit of the tandem-type electrophotographic image forming apparatus.

However, a related problem is that the tandem-type electrophotographic image forming apparatus can cause improper composition of the single color images resulting in color shift in a composite image, thereby degrading the quality of the composite image.

One approach to solve this problem is to provide a so-called "color shift correction" that can eliminate the drawback by forming toner pattern images on a transfer belt, causing an optical sensor to detect the toner pattern images, and adjusting a timing of optical writing based on the information detected by the optical sensor. Further, a shutter controlled by a solenoid, for example, is provided to cover the optical sensor unit and open only when detecting toner pattern images, so as to protect the optical sensor unit from contamination due to toner particles scattered inside the image forming apparatus, which degrades detection accuracy of the optical sensor.

However, it is likely that toner pattern images formed on the image transfer belt during such color shift correction adhere to and contaminate a secondary transfer roller that is held in contact with the image transfer belt used in the intermediate transfer unit, and therefore a back side of the transfer sheet is also contaminated.

To prevent such contamination of the back side of the transfer sheet, another known image forming apparatus further employs a mechanism to switch a position of the secondary transfer roller, i.e., to periodically contact and separate from the image transfer belt, so that the secondary transfer roller can separate from the image transfer belt during the color shift correction. Further, in such image forming apparatus the shutter is provided to prevent the detection accuracy of the optical sensor from deteriorating, a fixed motor is used as a drive source, a solenoid is provided in a drive array and disposed near the shutter, and a swing mechanism is also provided in the drive array and disposed near the fixing motor. By controlling forward and reverse rotations of the fixed motor, this configuration opens and closes the shutter and controls the contact and separation of the secondary transfer roller.

The above-described configuration, however, requires additional mechatronics parts and components such as solenoid and brush motor, which can cause an increase in cost, power consumption, and machine size. Moreover, the additional mechatronics parts and components can adversely affect the reliability of the image forming apparatus.

Therefore, there is still a need for an image forming apparatus that can effectively operate (open and close) the shutter and control the movement of the secondary transfer roller without adding mechatronics parts and components and increasing machine size, costs, and power consumption.

SUMMARY OF THE INVENTION

Exemplary aspects of the present invention have been made in view of the above-described circumstances.

Exemplary aspects of the present invention provide an image forming apparatus that can effectively operate (open and close) a shutter and control the movement of a secondary transfer roller without adding mechatronics parts and components and increasing machine size, costs, and power consumption.

In one exemplary embodiment, an image forming apparatus includes an image forming unit configured to form a toner image on an image bearing member, an endless belt configured to transfer and carry the toner image thereon, a transfer unit configured to transfer the toner image carried by the endless belt onto a recording sheet, a sensing unit configured to sense the toner image transferred onto the endless belt, a blocking unit mounted between the sensing unit and the endless belt and configured to block the sensing unit, and a contact and separation unit configured to cause the transfer unit to reciprocally contact and separate from the endless belt, so that the blocking unit and the contact and separation unit are configured to be driven by an identical drive source.

The blocking unit may close in synchronization with separation of the transfer unit from the endless belt by the contact and separation unit.

The blocking unit and the contact and separation unit may include a common member to synchronize operations performed by the blocking unit and the contact and separation unit.

The above-described image forming apparatus may further include at least one detector configured to detect opening and closing of the blocking unit and contact and separation of the transfer unit from the endless belt by the contact and separation unit.

The transfer unit disposed in the vicinity of the blocking unit and the contact and separation unit may be driven by the drive source for driving the blocking unit and the contact and separation unit.

The above-described image forming apparatus may further include a registration member configured to convey a recording medium according to a given timing. The registration member may be driven by the drive source driving the blocking unit and the contact and separation unit.

The above-described image forming apparatus may further include a drive blocking member provided to at least one of the drive source and the contact and separation unit.

The drive blocking member may include a one-way clutch.

The above-described image forming apparatus may further include multiple drive blocking members provided to the drive source and a drive array of a member driven by the drive source.

The multiple drive blocking members may include a one-way clutch.

The blocking unit may be in the open condition and the contact and separation unit may separate the transfer unit from the endless belt only when a toner image is being transferred on the endless belt and the sensing unit senses information of the toner image, and the blocking unit may remain closed and the transfer unit remaining contacted against the endless belt by the contact and separation unit at all other times.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
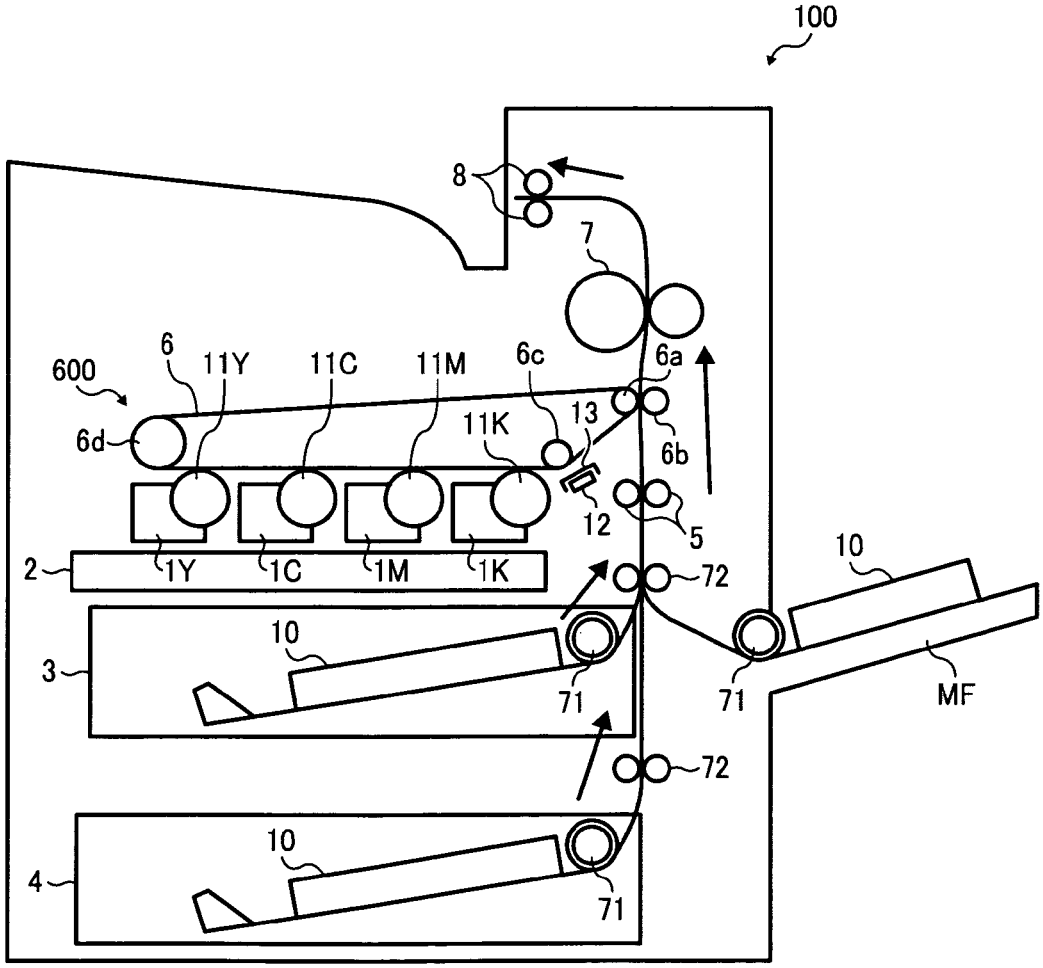
FIG. 1 is a schematic cross-sectional view of a schematic configuration of a color printer according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring now to the drawings, wherein like reference numerals designate identical or corresponding parts throughout the several views, preferred embodiments of the present invention are described.

Referring to FIG. 1, a schematic configuration of a color laser printer or laser printer 100 according to an exemplary embodiment of the present invention is described.

FIG. 1 is a schematic cross-sectional view of the laser printer 100 employing a tandem-electrophotographic method and an intermediate transfer method.

The laser printer 100 of FIG. 1 includes four toner image forming units 1Y, 1M, 1C, and 1K, an intermediate transfer unit 600.

The four toner image forming units 1Y, 1M, 1C, and 1K form respective toner images of different colors that are yellow (Y), magenta (M), cyan (C), and black (K). Hereinafter, the suffixes "Y", "M", "C", and "K" indicate that a member having a specific suffix includes a corresponding one of respective colors of yellow, magenta, cyan, and black.

The four toner image forming units 1Y, 1M, 1C, and 1K include four photoconductor drums 11Y, 11M, 11C, and 11K, respectively, and respective developing units, not shown.

The intermediate transfer unit 600 is disposed above the toner image forming units 1Y, 1M, 1C, and 1K, and includes an intermediate transfer belt 6. The intermediate transfer belt 6 forms an endless loop as an endless belt, and transfers the toner images formed on the photoconductor drums 11Y, 11M, 11C, and 11K by the toner image forming units 1Y, 1M, 1C, and 1K, respectively, onto the intermediate transfer belt 6. When transferred, the toner images are sequentially overlaid onto a surface of the intermediate transfer belt 6 to form a composite, full-color toner image. The intermediate transfer belt 6 is supported and spanned around by a drive roller 6*a*, and drive rollers 6*c* and 6*d*, and sandwiched by the drive roller 6*a* and a secondary transfer roller 6*b* disposed facing the drive roller 6*a*.

The laser printer 100 according to an exemplary embodiment of the present invention further includes an optical writing unit 2, sheet feeding cassettes 3 and 4, a pair of registration rollers 5, the intermediate transfer belt 6, a fixing unit 7, a pair of sheet discharging rollers 8, and a manual sheet feeding tray MF.

The optical writing unit 2 includes a light source, a polygon mirror, an f-theta lens, reflection mirrors, and so forth, and scans and emits laser light beams to respective surfaces of the photoconductor drums 11Y, 11M, 11C, and 11K based on image data, to form respective electrostatic latent images on the surfaces of the photoconductor drums 11Y, 11M, 11C, and 11K.

Arrows shown in FIG. 1 indicate a sheet conveying path of a recording sheet 10 accommodated in the sheet feeding cassettes 3 and 4, and the manual sheet feeding tray MF. The recording sheet 10 is fed by a feed roller 71 from any one of the sheet feeding cassettes 3 and 4, and the manual sheet feeding tray MF, guided by a conveyance guide, not shown, and conveyed by a pair of conveyance rollers 72 to the pair of registration rollers 5. At the pair of registration rollers 5, the recording sheet 10 is stopped for a given period while forming a bow shape between the pair of conveyance rollers 72 and the pair of registration rollers 5. After the given period has elapsed, the recording sheet 10 is conveyed by the pair of registration rollers 5 toward a nip contact formed between the drive roller 6*a* and the secondary transfer roller 6*b*. Affected by a transfer electrical field of the secondary transfer roller 6*b* and a nip pressure exerted to the nip contact between the drive roller 6*a* and the secondary transfer roller 6*b*, the composite toner image formed on the surface of the intermediate transfer belt 6 is transferred onto a surface of the recording sheet 10.

The recording sheet 10 having the full-color toner image thereon is then conveyed to the fixing unit 7 to fix the full-color toner image to the surface of the recording sheet 10, and conveyed via the pair of sheet discharging rollers 8 to an outside of the color laser printer 100. By performing a series of the above-described operations, a copy or print of full-color image can be produced.

The color laser printer 100 further includes image sensors 12 and a shutter plate 13. Details of the image sensors 12 and the shutter plate 13 will be described later.

Next, a detailed description is given of main parts and components of the laser printer 100 according to an exemplary embodiment of the present invention.

Figure 2A:
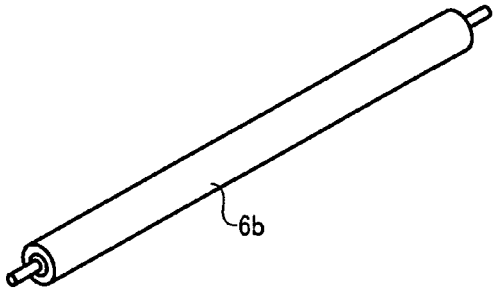
FIG. 2A is an exploded perspective view of a secondary transfer roller provided in the color printer of FIG. 1.
Figure 2B:
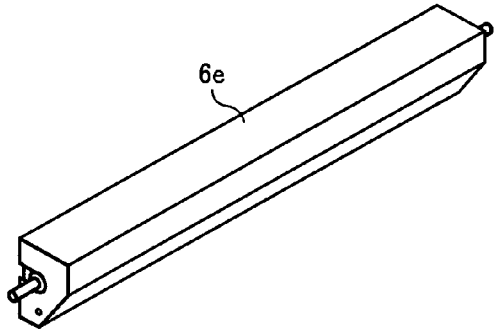
FIG. 2B is an exploded perspective view of a bracket including the secondary transfer roller of FIG. 2A.
Figure 2C:
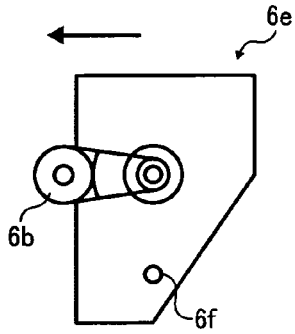
FIG. 2C is a side view of the bracket of FIG. 2B, viewed from a longitudinal direction of the bracket.

FIGS. 2A, 2B, and 2C show exploded perspective views of details of the intermediate transfer unit 600.

As previously described, the intermediate transfer belt 6 is extended by three supporting rollers: the drive roller 6*a*, the driven roller 6*c* disposed upstream from the drive roller 6*a*, and the driven roller 6*d* disposed downstream from the drive roller 6*a*.

The secondary transfer roller 6*b* of FIG. 2A includes a shaft, both ends of which are supported by a guide bracket 6*e* as shown in FIG. 2B. The guide bracket 6*e* also serves as a sheet conveyance guide plate, and can open and close about a fulcrum 6*f* to remove jammed papers during paper jam. When the guide bracket 6*e* is closed, a pressing member, not shown, presses the secondary transfer roller 6*b* in a direction indicated by an arrow in FIG. 2C to position the secondary transfer roller 6*b*.

Figure 3A:
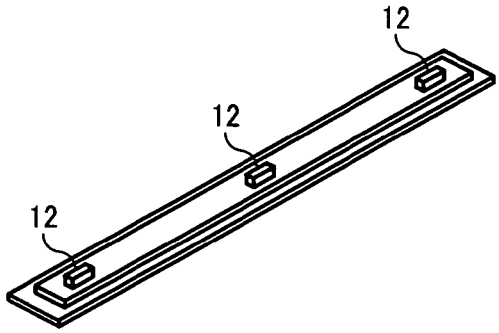
FIG. 3A is a perspective view of sensors provided in the color printer of FIG. 1.

In the vicinity of the driven roller 6*c*, the image sensors 12 to read and detect toner pattern images formed on the intermediate transfer belt 6 are disposed. As shown in FIG. 3A, the image sensors 12 are integrally mounted on a bracket, not shown, at given intervals. The bracket with the image sensors 12 is positioned at front and rear side plates, not shown, of a main body of the laser printer 100.

Figure 3B:
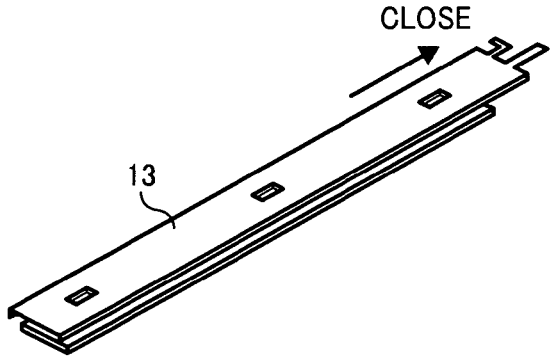
FIG. 3B is a perspective view of a shutter provided over the sensors of FIG. 3A, which is in a close state covering the shutters.
Figure 3C:
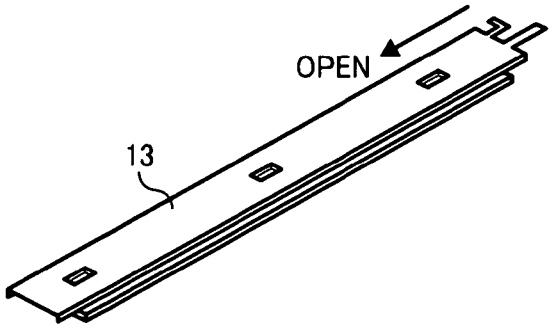
FIG. 3C is a perspective view of the shutter in an open state showing the sensors.

Between the image sensors 12 and the driven roller 6*c*, the shutter plate 13 is disposed. As shown in FIGS. 3B and 3C, the shutter plate 13 is disposed slidably in a longitudinal axis of the driven roller 6*c* along a guide rail, not shown.

Figure 4A:
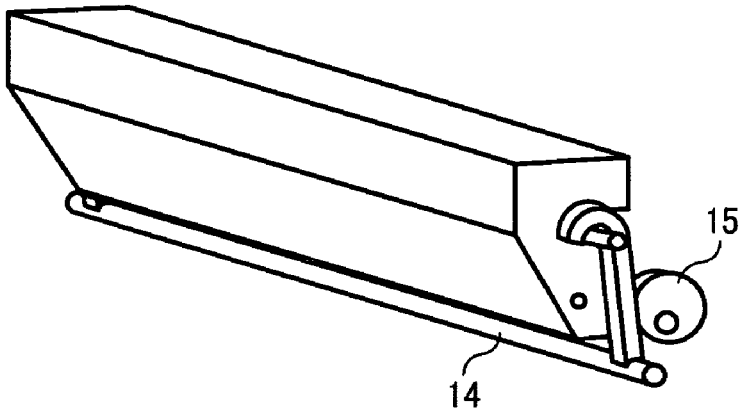
FIG. 4A is a perspective view of the bracket of FIG. 2B and a position switching mechanism for the secondary transfer roller of FIG. 2A.
Figure 4B:
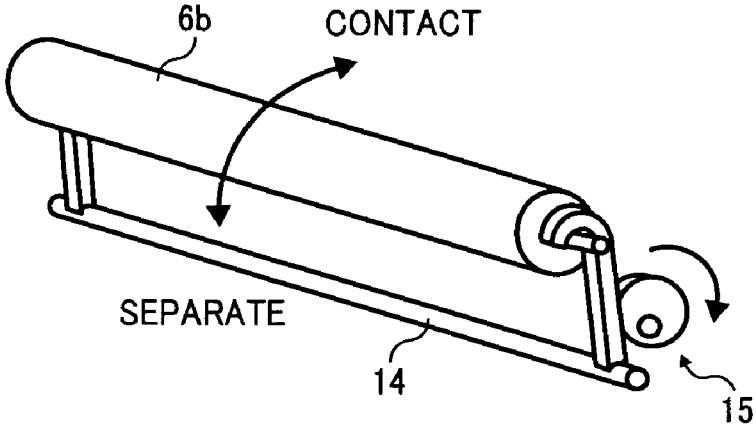
FIG. 4B is a perspective view for explaining operations of the position switching mechanism of FIG. 4A.

Further, as shown in FIGS. 4A and 4B, a lever 14 and a cam 15 are provided in the vicinity of the guide bracket 6*e*. The lever 14 is engaged with both ends of the secondary transfer roller 6*b*.

The cam 15 presses contact one end of the lever 14 to move the secondary transfer roller 6*b* in synchronization with a movement of the cam 15 in directions indicated by a bi-directional arrow shown in FIG. 3B. For example, when an apex of the cam 15 having a longest distance on a flat part (see FIG. 5B) from a center of the cam 15 comes to contact with the lever 14, the secondary transfer roller 6*b* is pressed to a contact position to contact with the intermediate transfer belt 6. When the lever 14 is in contact with a part other than the apex of the cam 15, the secondary transfer roller 6*b* separates from the intermediate transfer belt 6 to a non-contact position.

Thus, the lever 14 and the cam 15 interact with each other to serve as a contact and separation unit.

Figure 5A:
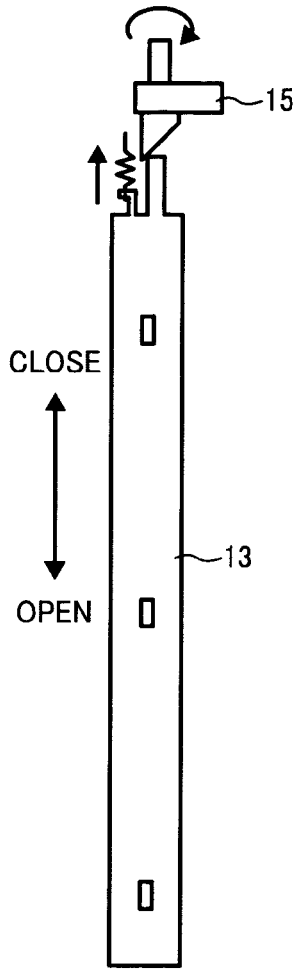
FIG. 5A is a plan view for explaining an operational relation of the shutter of FIGS. 3B and 3C and a cam pressed contact to the shutter.
Figure 5B:
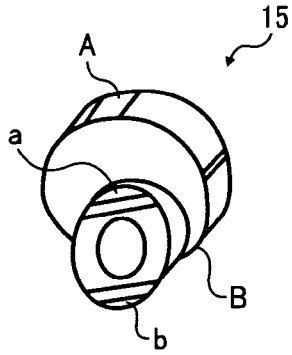
FIG. 5B is a perspective view of the cam of FIG. 5A.

Next, a description is given of operations of the shutter plate 13, in reference to FIGS. 5A and 5B.

As described above, the shutter plate 13 moves in the longitudinal axis of the driven roller 6*c*. As shown in FIG. 5B, the cam 15 includes a slanted part on the flat part. The shutter plate 13 is pressed by a pressing member to be held in contact with the slanted part of the cam 15 so as to move the shutter plate 13 reciprocally (for push and retreat) while the cam 15 rotates. As shown in FIG. 5B, a tip of the slanted part of the cam 15, which is indicated by "b", is arranged apart from the apex of the cam 15, which is indicated by "A", by 180 degrees, and therefore a timing that the shutter plate 13 moves to an open position to expose the image sensors 12 is equal to a timing that the secondary transfer roller 6*b* separates from the intermediate transfer belt 6.

Specifically, when the cam 15 comes to a position indicated by A/a shown in FIG. 5B, the shutter plate 13 moves to a close position and the secondary transfer roller 6*b* comes to the contact position to contact the intermediate transfer belt 6. By contrast, when the cam 15 comes to a position indicated by B/b shown in FIG. 5B, the shutter plate 13 moves to the open position and the secondary transfer roller 6*b* comes to the non-contact position to separate from the intermediate transfer belt 6.

Thus, the shutter plate 13 and the cam 15 interact with each other to serve as a blocking unit.

As described above, the cam 15 may be used as a common member to synchronize operations of the blocking unit and the contact and separation unit.

Figure 6A:
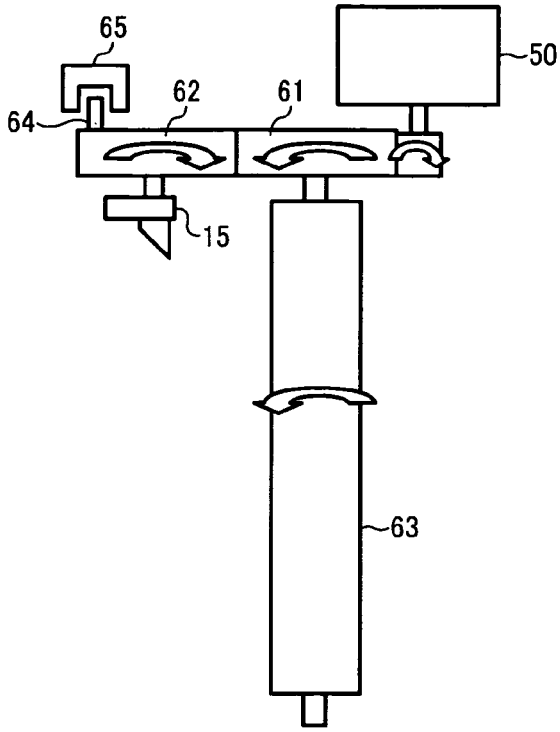
FIG. 6A is a plan view for explaining a drive transmission of a motor in a forward operation.
Figure 6B:
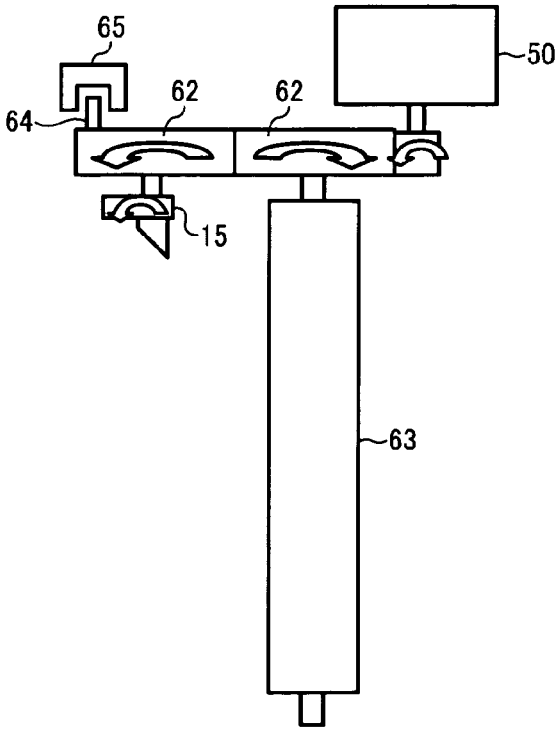
FIG. 6B is a plan view for explaining a drive transmission of the motor in a reverse operation.

Next, schematic configuration and functions of the drive array from a motor 50 serving as a drive source to the cam 15 according to an exemplary embodiment of the present invention are described, in reference to FIGS. 6A and 6B.

FIG. 6A shows a drive transmission of the motor 50 in a forward direction, and FIG. 6B shows a drive transmission of the motor 50 in a reverse direction. The drive array further includes two one-way clutches: a one-way clutch 61 is disposed on a shaft of the registration roller 63, and a one-way clutch 62 is disposed on a shaft of the cam 15. The one-way clutches 61 and 62 lock the movements of the registration roller 63 serving as a registration member and the cam 15 when rotating in a specific direction.

Specifically, as shown in FIG. 6A, when the motor 50 rotates in the forward direction, the one-way clutch 61 locks or engages with the registration roller 63 to rotate in a direction to convey the recording sheet, and the one-way clutch 62 idles or does not engage with the cam 15, thereby causing the cam 15 to remain unrotated. By contrast, when the motor 50 rotates in the reverse direction, the one-way clutch 62 locks or engages with the cam 15 to rotate, and the one-way clutch 61 idles or does not engage with the registration roller 63, thereby causing the registration roller 63 to remain unrotated.

The position of the cam 15 is detected by a filler 64 and a sensor 65 each serving as a detector and disposed on the one-way clutch 62. When the cam 15 reaches a desired position, the motor 50 stops.

If the color shift correction is allowed to interrupt conveyance of the recording sheet 10, when the recording sheet arrives to the registration roller 63, the one-way clutch 62 may be needed so as not to convey the recording sheet in a direction opposite to the sheet conveyance direction when the motor 50 rotates in an opposite direction. Therefore, when the sequence is controlled not to perform the color shift correction during the conveyance of the recording sheet 10, the one-way clutch 62 is not necessary. Further, a spring-type one-way clutch and a needle type one-way clutch can achieve the same effect.

As described above, a use of identical drive source to drive the blocking unit and the contact and separation unit can reduce the number of mechatronics parts, thereby achieving a reduction of cost and of power consumption.

Further, synchronization of an open state of the blocking unit with a non-contact state of the contact and separation unit can prevent contamination of a secondary transfer roller during the color misregistration correction or the density correction.

Further, by detecting the open and close states of the blocking unit and the contact and non-contact states of the contact and separation unit, the blocking unit can surely open and close and the contact and separation unit can surely control the contact and separation of the secondary transfer roller.

Further, by causing the drive source of the blocking unit and the contact and separation unit to also drive the conveyance roller disposed nearby, a simpler drive array can be formed, which can achieve an increase of efficiency and a reduction of cost.

Furthermore, by causing the drive source of the blocking unit and the contact and separation unit to also drive the registration roller, a simpler drive array can be formed, which can achieve an increase of efficiency and a reduction of cost.

Further, by including at least one drive blocking member in the drive array from the drive source to the contact and separation unit, the switching of the contact state and the non-contact state of the contact and separation unit can be performed easily.

Further, when the drive array from the drive source to a member driven by the drive source includes multiple drive blocking members, the color misregistration correction and the density correction can be performed without being affected by the sheet conveyance operation and state. When a one-way clutch serves as the drive blocking member, the cost can be most effective and the switching can be surely performed.

Further, when the blocking unit moves to the close state while the color misregistration correction and the density correction are not performed, a degradation of detection accuracy due to contamination of the sensor can be prevented.

Furthermore, by separating the secondary transfer roller during the color misregistration correction and the density correction, the background contamination of the transfer sheet can be reduced.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

an image forming unit configured to form a toner image on an image bearing member;

an endless belt configured to transfer and carry the toner image thereon;

a transfer unit configured to transfer the toner image carried by the endless belt onto a recording sheet;

a sensing unit configured to sense the toner image transferred onto the endless belt;

a blocking unit mounted between the sensing unit and the endless belt and configured to block the sensing unit;

a contact and separation unit configured to cause the transfer unit to reciprocally contact and separate from the endless belt, and a cam in contact with a surface of the blocking unit and the contact and separation unit, wherein the blocking unit and the contact and separation unit configured to be in driven contact with a common drive source, wherein the blocking unit is slidably movable along a longitudinal axis of a roller opposite the sensing unit and the cam is in driven contact with the common drive source and rotatable about a shaft, the cam including a tip projecting from a side wall of the cam in a direction parallel to the shaft and the tip engages the blocking unit.

2. The image forming apparatus according to claim 1, wherein the blocking unit closes in synchronization with separation of the transfer unit from the endless belt by the contact and separation unit.

3. The image forming apparatus according to claim 2, wherein the blocking unit and the contact and separation unit include a common member to synchronize operations performed by the blocking unit and the contact and separation unit.

4. The image forming apparatus according to claim 1, further comprising at least one detector configured to detect opening and closing of the blocking unit and contact and separation of the transfer unit from the endless belt by the contact and separation unit.

5. The image forming apparatus according to claim 1, wherein the transfer unit disposed in the vicinity of the blocking unit and the contact and separation unit is driven by the drive source for driving the blocking unit and the contact and separation unit.

6. The image forming apparatus according to claim 1, further comprising a registration member configured to convey a recording medium according to a given timing, the registration member driven by the drive source driving the blocking unit and the contact and separation unit.

7. The image forming apparatus according to claim 1, further comprising a drive blocking member provided to at least one of the drive source and the contact and separation unit.

8. The image forming apparatus according to claim 7, wherein the drive blocking member includes a one-way clutch.

9. The image forming apparatus according to claim 1, further comprising multiple drive blocking members provided to the drive source and a drive array of a member driven by the drive source.

10. The image forming apparatus according to claim 9, wherein the multiple drive blocking members include a one-way clutch.

11. The image forming apparatus according to claim 1, wherein the blocking unit is in the open condition and the contact and separation unit separates the transfer unit from the endless belt only when a toner image is being transferred on the endless belt and the sensing unit senses information of the toner image, the blocking unit remaining closed and the transfer unit remaining contacted against the endless belt by the contact and separation unit at all other times.

* * * * *